United States Patent [19]

Nichols et al.

[11] Patent Number: 4,843,941

[45] Date of Patent: Jul. 4, 1989

[54] GUITAR TREMOLO APPARATUS

[76] Inventors: Joseph C. Nichols, Apt. 5, 916 Ashland, St. Paul, Minn. 55104; Charles D. Orr, 118 W. 39th St., Minneapolis, Minn. 55409

[21] Appl. No.: 8,863

[22] Filed: Jan. 29, 1987

Related U.S. Application Data

[63] Continuation-in-part of Ser. No. 523,343, Aug. 15, 1983, abandoned.

[51] Int. Cl.[4] ..... G10D 3/04

[52] U.S. Cl. ..... 83/313; 84/293; 84/299

[58] Field of Search ..... 84/267, 293, 298, 299, 84/307, 313

[56] References Cited

U.S. PATENT DOCUMENTS

| | | | |
|---|---|---|---|
| 3,248,991 | 5/1966 | Cole | 84/313 |
| 4,248,126 | 2/1981 | Lieber | 84/299 |
| 4,385,543 | 5/1983 | Shaw et al. | 84/298 |
| 4,430,919 | 2/1984 | Matsui | 84/299 |
| 4,457,201 | 7/1984 | Storey | 84/313 |

*Primary Examiner*—Lawrence R. Franklin

*Attorney, Agent, or Firm*—Clayton R. Johnson

[57] ABSTRACT

Stringed instruments such as a guitar or the like that includes a head, a neck extending between the head and a body, tremolo apparatus having a base mounted on the body, a string mount pivotally mounted on the base, a handle assembly for selectively pivoting the string mount in a first direction from a datum position to increase the tension in the strings and alternately in a second direction from the datum position to decrease the tension in the strings, a stop member to limit the pivotal movement of the string mount in the second direction to the datum position when no manual force is being applied to the handle assembly while permitting the handle assembly being manually pivoted in the second direction from the datum position, spring mechanism constantly resiliently urging the stop member into abutting relationship with the base, skate mechanism mounted on the base for selectively adjusting the height of the strings, and truss mechanism mounted by the neck to counterbalance the pull of the strings that includes an elongated double channel mounted by the neck and two truss rods mounted by the channel for imparting bending and twisting forces to the channel.

26 Claims, 4 Drawing Sheets

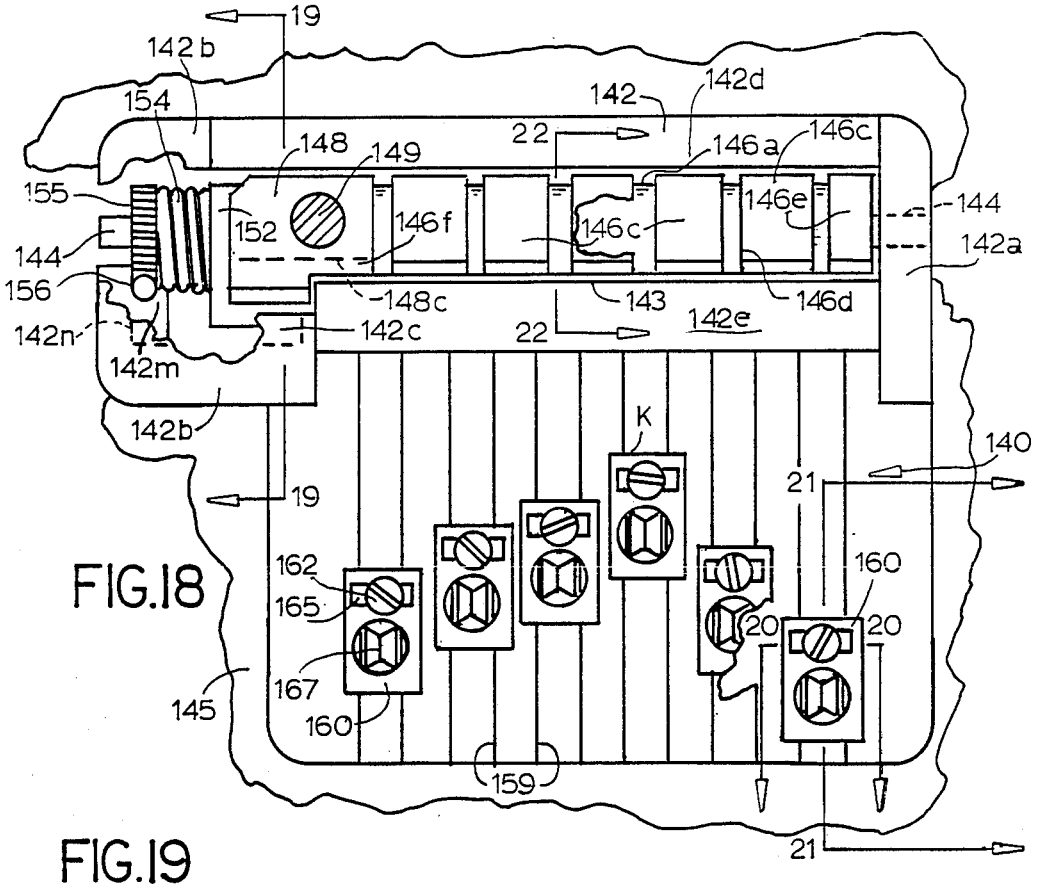
FIG.18
FIG.19
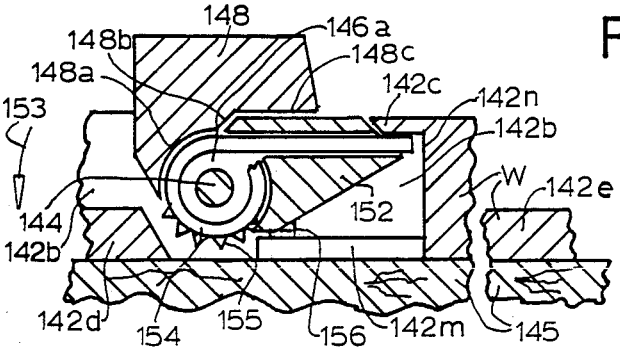
FIG.22
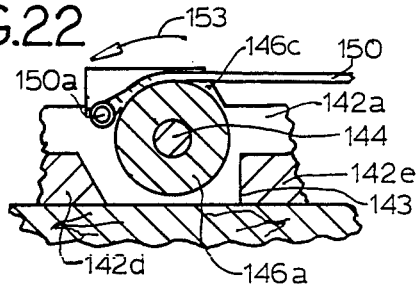
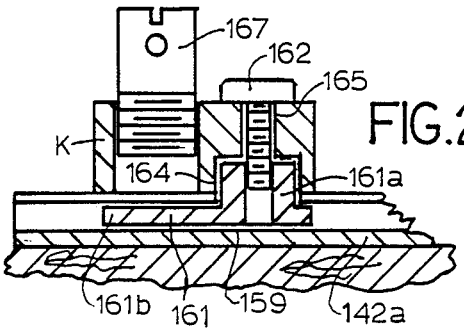
FIG.21
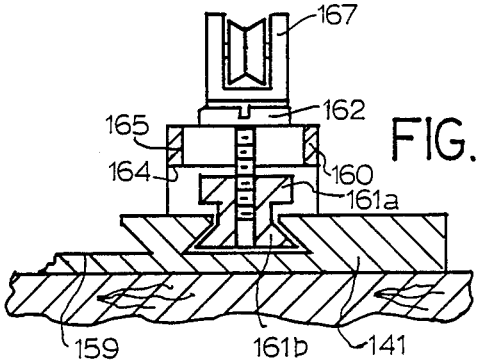
FIG.20

GUITAR TREMOLO APPARATUS

CROSS REFERENCE TO RELATED APPLICATIONS

This application is a continuation-in-part application of Ser. No. 523,343, filed Aug. 15, 1983 now abandoned.

BACKGROUND OF THE INVENTION

This invention relates to apparatus operable for selectively varying the tension applied to all the guitar strings and truss mechanism to counteract against bending forces imparted to the guitar neck by the guitar strings.

It is old to provide a tremolo device having an arm attached to a pivot shaft and ends of the strings attached thereto whereby pivoting the shaft will vary the tension in the strings; for example see U.S. Pat. No. Des. 169,120. Further it is old to provide a tremol device that includes a base plate having a beveled end portion which is secured to the guitar body by screws to permit limited pivotal movement about said end portion, bridge elements on the base plate having the strings connected thereto and a bar secured to the plate. A control arm is mounted by the bar for pivoting the plate in one direction while counterbalance springs force the plate to return to an original position (for example see U.S. Pat. No. 2,741,146 to Fender). Also it is old to provide tremolo apparatus that incorporates a leaf spring as the guitar bridge wherein one end is secured to the guitar body by screws and the other reversely bent end has the strings attached thereto and an arm is attached to said other end whereby moving the bar bends the whole bridge.

The above prior art devices work in essentially the same manner, the pull of the guitar strings being counterbalanced by the opposed spring tension. That is, when the arm is depressed the strings loosen, the pitch lowers and the springs tighten, whereas, when the arm is raised, the strings tighten, the pitch raises and the springs loosen or are placed in a condition for decreased tension. This causes problems in that the strings in being constantly stretched or loosened quickly loose their elasticity (or resilience) because they are not primarily designed for this purpose. However the balance spring has a relatively long life. Consequently, the balance point is constantly moving as the strings "go dead". As a result the guitar goes out of tune and requires re-tuning. Ultimately one string after another breaks. As each string is replaced, the new string is stronger than the one it replaces and again the guitar has to be retuned because the balance point has moved.

Also it is old in the prior art to provide a skate on the bridge of the guitar together with one or two screws threaded through it and abutting against the bridge for varying the angle of inclination of the skate relative to the bridge to thereby vary the height of the string portion adjacent the bridge relative to the bridge. As a result the transmission of vibrations from the strings to the bridge is not as good as desired.

Each of U.S. Pat. Nos. 4,385,201, 4,457,201 and 4,541,320 disclose an elongated member having one end portion rotatably mounting a saddle roller to abut against a string and a second end portion mounted to pivot about axes parallel to the roller axis. The one end portion is sufficiently movable relative to the base during playing that there is an undesirable loss of transmission of sound, i.e. don't obtain the solid sound transmission that is desirable.

Additionally in playing guitars having a tremolo apparatus there is a greater degree of twisting and bending of the neck than with guitars not having such apparatus due to the stress caused by the string pull being varied back and forth by the use of such apparatus. In the prior art a threaded truss rod has been placed in the neck at a slight angle with its opposite ends hooked into the neck. As the rod is turned relative the nut thereon the neck is straightened from the bending occurring from the pull of the strings. However because of the constant stress of the truss rod on the neck (in effect, trying to compact it) and also the peculiar characteristics of the wood, the neck often warps or twists. To overcome this twisting action, in the prior art, at times two truss rods have had their opposite ends hooked into the neck to be in side by side relationship, but transversely spaced. However the rods will cause the neck to move sideways, but do not correct the twisting. Further in the prior art a truss rod has been placed into an aluminum channel so that the truss rod pulls against the channel to bend it back, the channel being sunk into a neck so that when the channel is bent by turning the rod, the channel bends the neck. With this last mentioned arrangement the rod pulls against the channel rather than putting a compacting type of stress directly on the neck; however, this arrangement does not obviate the twisting that occurs.

In order to obviate and/or minimize problems such as the above, this invention has been made.

SUMMARY OF THE INVENTION

Tremolo apparatus for a stringed instrument such as a guitar or the like is disclosed that includes a base secured to the guitar body in fixed position, a string mount pivotally mounted by the base that is urged to pivot in one direction by the strings, a stop member pivotally mounted by the string mount, a counterbalance spring means acting between the guitar body or base and the stop member to urge it to pivot in a direction opposite said one direction with the base limiting the pivotal movement of the stop member in the opposite direction and a handle assembly for selectively pivoting the string mount in each of said one direction and the opposite direction and the stop member in said one direction. Advantageously skates are mounted on the base while saddles are vertically adjustably mounted by the skates for varying the height of the lengths of strings that extend toward the head relative to the body. Also, advantageously a double channel with a truss rod in each channel groove is provided in the guitar neck to bend and/or twist the channel groove back to straighten the neck.

One of the objects of this invention is to provide new and novel tremolo means for s lectively raising and lowering the guitar pitch by respectively tightening and loosening the string tension. In furtherance of the above object it is another object of this invention to provide tremolo means wherein the string mounting means returns to its exact starting position upon release of the tremolo arm regardless of any weakening in string tension.

Still another object of this invention is to provide new and novel means for adjusting the height of the guitar strings relative to the guitar body and transmitting the vibrations of the strings to the guitar body. A further object of this invention is to provide new and novel means for straightening the neck of the guitar by imparting twisting and/or bending forces to the neck and retaining the neck in the straightened condition.

Another object of this invention is to provide new and novel means for mounting the tremolo arm of a tremolo device to permit the arm being swung out of the way and/or adjusting its effective length and/or adjusting its relative angle to the guitar body and/or for removing it completely.

BRIEF DESCRIPTION OF THE DRAWINGS

FIG. 18 is a fragmentary plan view of the fourth embodiment of the invention with part of the base broken away to show the adjustable spring force feature and the stop member;

FIG. 19 is a fragmentary longitudinal cross sectional view generally taken along the line and in the direction of the arrows 19—19 of FIG. 18 to further show the adjustable spring force feature and the stop member; and show the handle mount and stop member in their datum positions;

FIG. 20 is a longitudinal cross sectional view of a skate and saddle assembly that is generally taken along the line and in the direction of the arrows 20—20 of FIG. 18;

FIG. 21 is a transverse cross sectional view through a skate assembly that is generally taken along the line and in the direction of the arrows 21—21 of FIG. 20; and FIG. 22 is a longitudinal cross sectional view through the grooved portion of the string mount of the fourth embodiment.

Referring to FIG. 1 there is shown a guitar having a neck 11 extending between the body 12 and head 13, a plurality of strings 14 extending from the tuning posts 15, over the nut 16 and fretboard 17 on the neck and to the bridge B. The bridge B shown in FIGS. 2, 3 and 6 includes the first embodiment of the tremolo apparatus of this invention, generally designated 20, that has a metal base 21 having a base plate **21*a* secured to the body by, for example, screws 22 to in part overhang the slot 23 that extends through the body. Integrally joined to opposite longitudinal edges of the base plate to extend thereabove and rearwardly thereof are flanges 21*b*, 21*c*, respectively. A string mount that includes a transverse shaft 24 is pivotally mounted by the base flanges 21*b*, 21*c* to at least in part overhang slot 23**.

Figure 1:
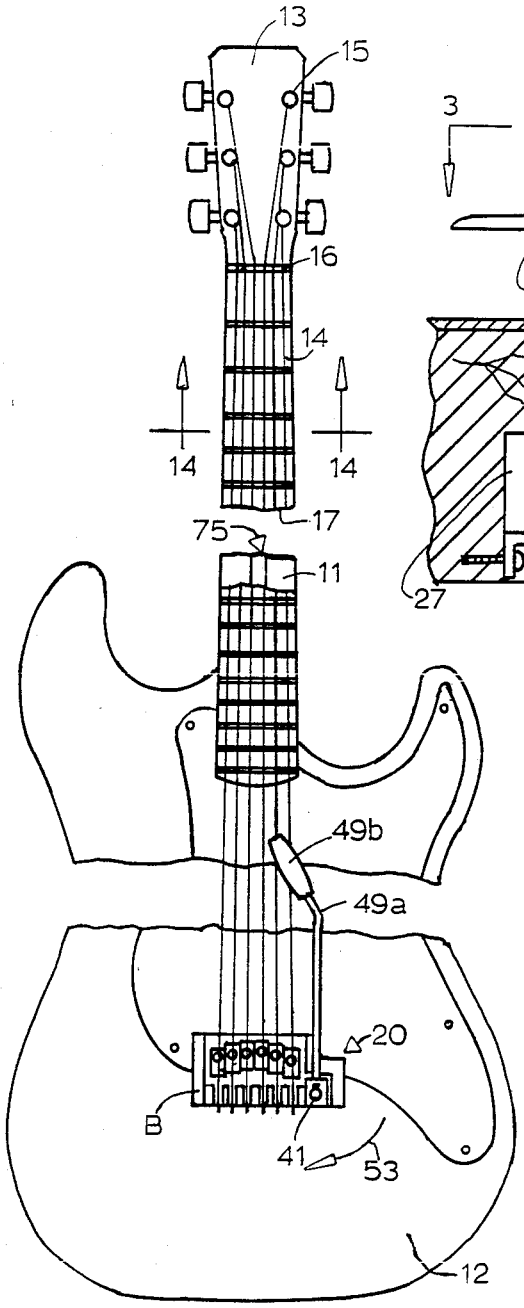
FIG. 1 is a plan view of a guitar having the first embodiment of the tremolo device of this invention thereon, longitudinally intermediate portions of the neck, fretboard and body being broken away.
Figure 2:
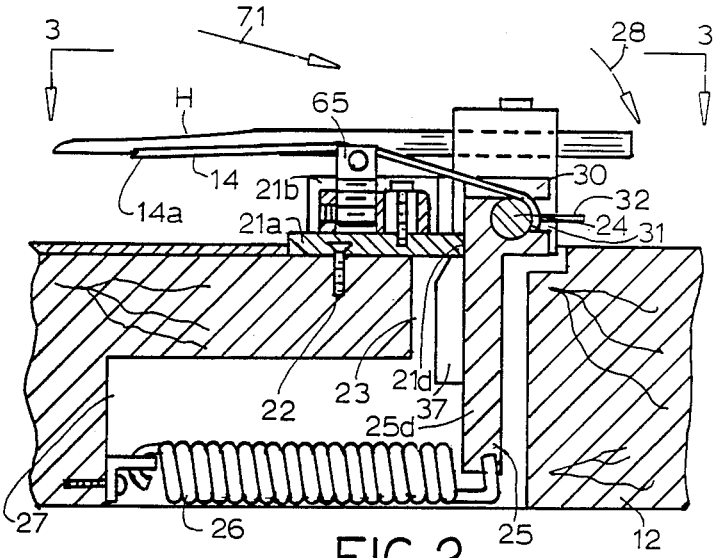
FIG. 2 is a fragmentary longitudinal cross sectional view showing the first embodiment in a datum condition, said view being generally taken along the line and in the direction of the arrows 2—2 of FIG. 3.

A stop member 25 has an upper portion mounted by the shaft for pivotal movement relative thereto and a lower integrally joined portion that extends downwardly from the upper portion into slot 23. The lower end of member 25 mounts one ends of counterbalance springs 26 (only one shown), the opposite ends of the springs being secured to the front wall portion that in part defines the downwardly opening groove 27. The rearward end portion of the groove 27 opens to the lower portion of slot 23. The counterbalance springs constantly resiliently urge the stop member to pivot in the direction of arrow 28, the pivotal movement in said direction being limited by abutting against the rear edge **21*d* of the base plate 21*a***.

The stop member has a top opening groove 30 for each of the guitar strings that extends longitudinally thereacross and opens to the shaft and the groove 31. The rear end portion of each string extends through groove 30, into groove 31 and is mounted by a pin 32 that is secured to the shaft to extend radially rearwardly therefrom in groove 31 when the shaft is in its datum position. The strings constantly urge the shaft to pivot in the direction opposite arrow 28. The groove 31 extends axially between opposite end portions **25*a*, 25*b* of the upper portion of the stop member, end portions 25*a*, 25*b*** surrounding the shaft.

Figure 3:
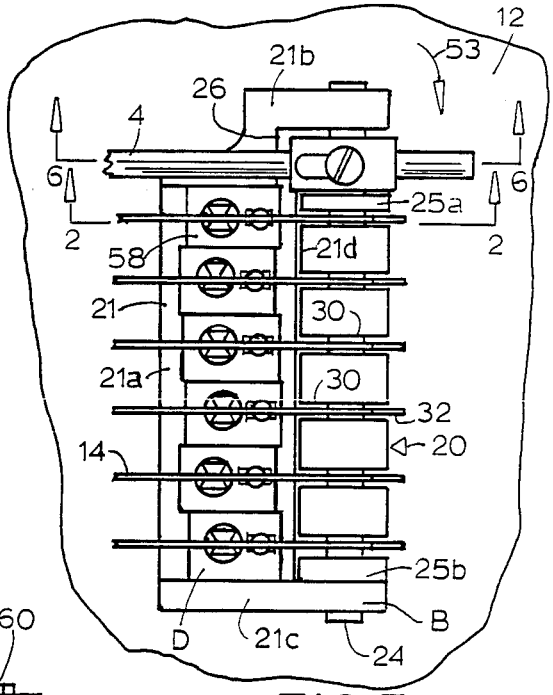
FIG. 3 is an enlarged fragmentary plan view showing the first embodiment.
Figure 4:
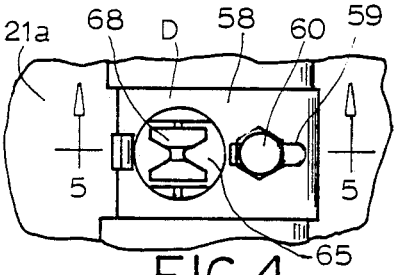
FIG. 4 is an enlarged fragmentary plan view of the skate and saddle assembly, the string that is extended thereover not being shown.
Figure 5:
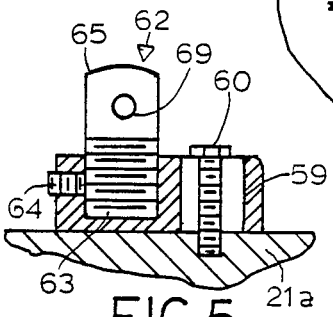
FIG. 5 is a longitudinal cross sectional view generally taken along the line and in the direction of the arrows 5—5 of FIG. 4.
Figure 6:
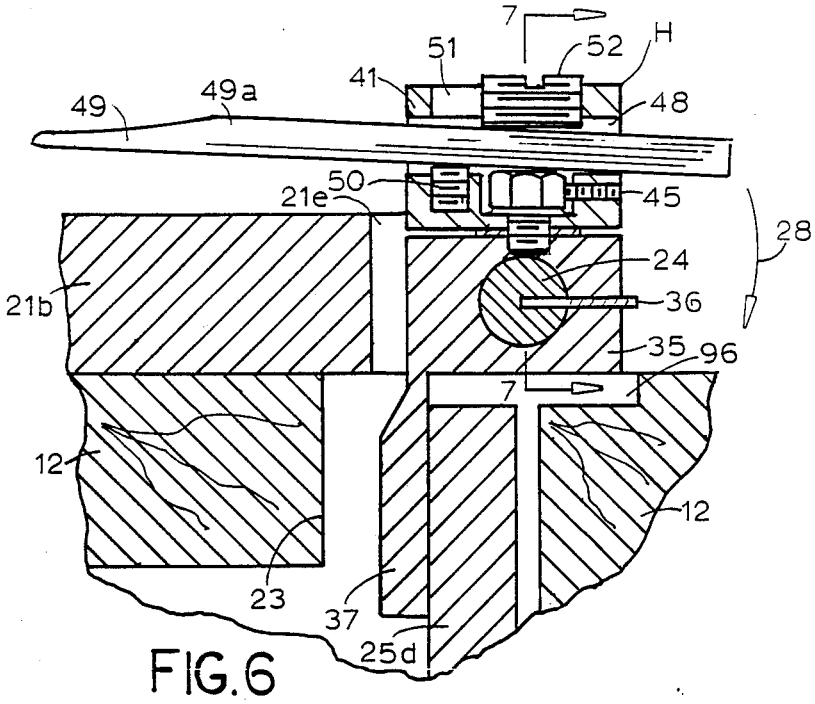
FIG. 6 is a fragmentary longitudinal cross sectional view generally taken along the line and in the direction of the arrows 6—6 of FIG. 3 to show the mounting of the handle assembly rod.
Figure 7:
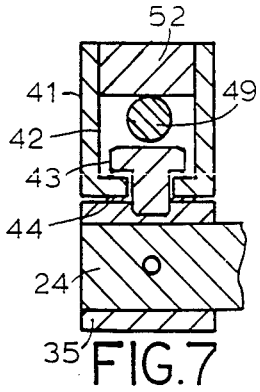
FIG. 7 is a fragmentary cross sectional view generally taken along the line and in the direction of the arrows 7—7 of FIG. 6.

In order to selectively pivot the shaft in either angular direction there is provided a handle assembly H; see FIGS. 3, 6 and 7. The handle assembly includes a mount 35 having the shaft extended therethrough, set screw or pin 36 being provided to secure the mount in a fixed angular position on the shaft. A pusher arm 37 is secured to or integrally joined to the mount to extend into the slot 23 and in a position to abut against the front surface of the stop member.

A clamp block 41 has a vertical bore 42 extending therethrough which has an upper portion of an enlarged diameter to permit the head of the bolt 43 turned therein and a lower portion through which the threaded end of the bolt extends and is threaded into mount 35. The bolt extends through a spring washer 44 positioned between the block and mount to resiliently urge the block away from the mount. The bolt head in abutting against the shoulder formed by the enlarged bore portion and the lower portion limits the upward movement of the block. A set screw 45 is threaded into the block and abuts against the bolt head to prevent the bloc rotating relative to the bolt.

An arm aperture 48 extends horizontally though the clamp block at an elevation above the head of bolt 43 and through the central vertical axis of bore 42. An elongated slot 51 in the top portion of the clamp block opens to the upper threaded part of the enlarged diametric portion of bore 42 and to the aperture 48 to permit a tool being extended therethrough to adjust the set screw 50 that is threaded in the clamp block whereby the vertical distance the screw extends into aperture 48 can be varied. A set screw 52 is threaded into the upper threaded part of bore 42. The rod 49*a* of tremolo control arm 49 is extended through aperture 48, the diameter of the rod being sufficiently less than the height of aperture 48 which is elongated in a vertical direction to permit the adjustment of the angle of inclination of the arm (or if the arm is not straight as shown in FIG. 1, the linear portion of the arm adjacent the shaft 24 in the position shown in the drawings) relative to the mount, base plate and top surface of the body in a vertical plane that is perpendicular to the pivot axis of shaft 24, the base and the top surface of the body. Thus by adjusting the distance the screw 50 extends into aperture 48 to abut against the control arm rod 49*a* and threading screw 52 to clampingly abut against the top of said rod the angle of inclination is changed. Further the rod is held in a fixed position relative to the block since the rod undersurface that is on the opposite side of screw 52 from screw 50 abuts against a part of the block wall portion that defines aperture 48. By loosening screw 52 and then pushing or pulling on the arm and thereafter again tightening screw 52 the effective length of the control arm can be varied, i.e. the distance from the end of the control arm handle 49*b* remote from the clamp block to the adjacent side of the clamp block. Further by removing control arm 49, loosening screw 45 and turning bolt 43 in the appropriate direction the amount of force required to rotate the arm, block 41 and bolt 43 in the direction of arrow 53 from the FIG. 1 position, and the amount of force required to hold the arm in various rotated positions can be varied as the result of the change in the degree of compression of spring washer 44. Thus the control arm can be pivoted relative to the string mount about a pivot axis that is perpendicular to a plane that is parallel to the string mount pivot axis and the force required to pivot the arm relative the string mount can be varied.

Referring to FIGS. 2–5, the metal skate and saddle assembly D for each string is the same and includes a skate 58 having a planar bottom for abutting against the top planar surface of the base plate 21*a*. Each skate has a longitudinally elongated slot 59 for having a cap screw 60 extended therethrough and threaded into the base plate for retaining the skate in selected fixed longitudinal adjusted positions relative the shaft 24. The skates are located transverse the strings between the flanges 21*b*, 21*c* in sufficiently close relationship to prevent the skates pivoting about screws 60 when loosened while permitting them being longitudinally adjusted relative to one another.

Figure 8:
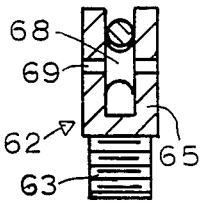
FIG. 8 is a transverse cross sectional view of a saddle and showing a string extended over the saddle roller.
Figure 9:
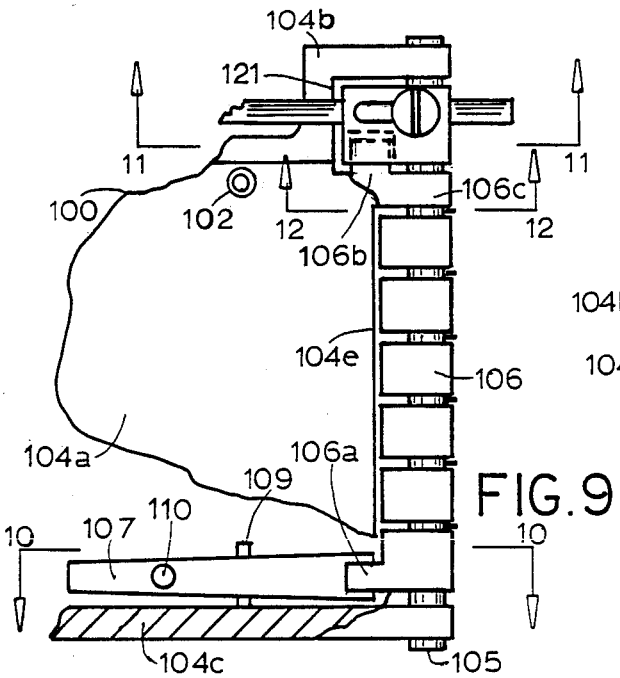
FIG. 9 is a fragmentary plan view showing the second embodiment of the invention with part of the base broken away and the skate and saddle assemblies and strings not being shown.
Figure 11:
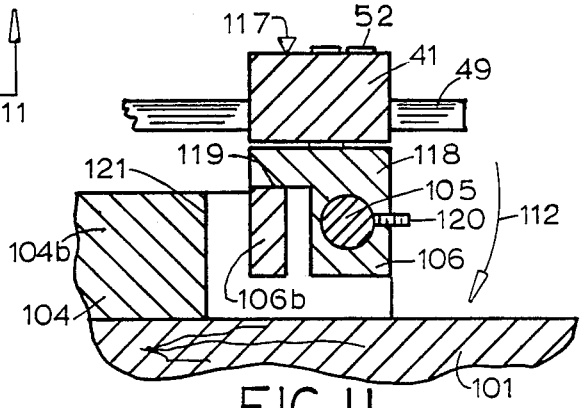
FIG. 11 is longitudinal cross sectional view generally taken along the line and in the direction of the arrows 11—11 of FIG. 9.

Each assembly D includes a saddle generally designated 62, that includes a roller mount which has a threaded end portion 63 that is threaded into the skate and an upper bifurcated end portion 65 extended above the skate (also see FIG. 8). A set screw 64 is threaded into the skate for abutting against the threaded end portion to retain the saddle in selected vertically adjusted, fixed positions relative to the skate and to insure there is a good transmission of vibrations from the saddle to the skate. The saddle also includes a grooved roller 68 mounted for rotation about a horizontal axis by a shaft 69 that in turn is mounted by the legs of the bifurcated portion.

The strings extend rearwardly from the nut 16, then over the rollers 68 and thence into grooves 30, 31 to have their rear ends mounted by pins 32. Assuming the strings are above the neck and body, all of the saddles are at their lowermost adjusted elevations relative to the base, the saddles transversely aligned and the portions 14*a* of the strings between the nut and the saddles extend horizontally to be at least substantially located in a common horizontal plane, the portions of the strings between the saddles and shaft 24 being inclined downwardly in a rearward direction (arrow 71) relative to portions 14*a*. As a result the strings remain in abutting relationship to rollers 68, even when shaft 24 is pivoted as will be described hereinafter. As a result the vibrations caused by strumming of the strings by the guitar player will be transmitted to the guitar body through a solid chain, i.e. through the rollers and their shafts, the roller mount and the skates to the body. Relative thereto screw 64 retains the roller mount (saddle) fixed relative to the skate. It is to be mentioned that in the adjusted positions, the saddles have roller shaft axes extending generally perpendicular to the strings so that when the shaft 24 is pivoted the rollers will freely rotate with the movement of the strings thereover.

Figure 15:
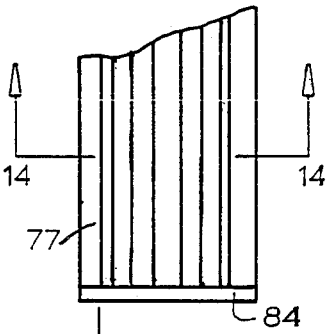
FIG. 15 is a bottom view of the channel truss mechanism.
Figure 16:
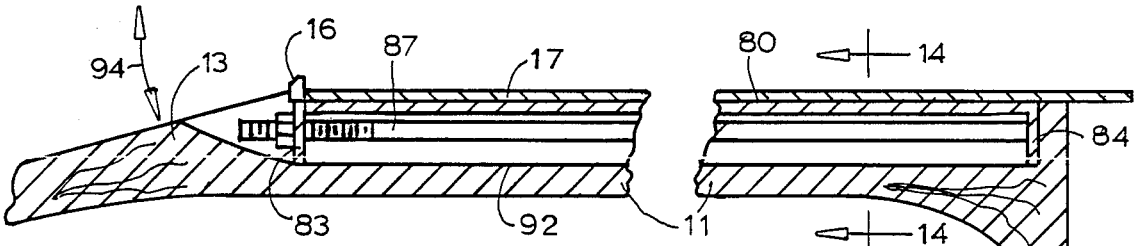
FIG. 16 is a longitudinal cross sectional view generally taken along the line and in the direction of the arrows 16—16 of FIG. 15 to further show the mounting of the channel truss mechanism in the neck portion of a guitar.
Figure 14:
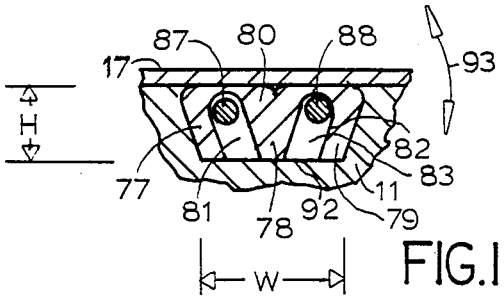
FIG. 14 is a transverse cross sectional view of the neck portion of a guitar showing the channel truss mechanism of this invention mounted thereon, said view being generally taken along the line and in the direction of the arrows 14—14 of FIGS. 15 and 16.

Referring to FIGS. 14–16, the truss assembly T of this invention includes a longitudinally elongated double channel, generally designated 75, having a top web 80, longitudinally opposite end walls 83, 84 and legs 77–79 that define grooves 81, 82 that open opposite the web and diverge from one another in a direction toward the web. The transversely remote side surfaces of the channel legs 77, 79 also diverge from one another in a direction toward the web. The width W of the bottom of the channel, which is its minimum width, is greater than the height of the channel, while the grooves are of the same size and shape other than transversely diverging in a direction toward the web (one a right hand groove and the other a left hand groove). Further the heights of the grooves are desirably at least about twice the dimensions of the widths thereof.

Longitudinally elongated truss rods 87, 88 extend within grooves 81, 82 respectively to have their one ends fixedly joined to end wall 84 and opposite threaded end portions extended through end wall 83. Nuts 89 are threaded on the threaded end portions of the truss rods to abut against end wall 83 exterior of the grooves. The rods are located adjacent the web, i.e. remote from the bottom of the channel.

A longitudinally elongated groove 92 is provided in the neck to open to the undersurface of the fretboard and extends forwardly of the neck to open through the top rear portion of the head. Groove 92 in transverse cross section is of a size and shape to snugly receive the channel and of a length to have its rear end adjacent the juncture of the neck to the body. A layer of suitable adhesive that remains flexible when cured is applied to the wall portions of the neck that define the front end, sides and bottom of the groove 92 before placing the channel in said groove to adhere the channel to the neck and fill the voids between the rear, sides and bottom terminal surfaces of the legs and the neck. The forward end portion of groove 92 which is in the head extends forwardly of the nut and fretboard to permit access to the nuts 89 to permit tightening and loosening them on the rods.

With the truss assembly in the neck and after a period of time the strings cause the neck to bend in one direction of double arrow 94 of FIG. 16. By tightening both nuts the channel is bent to bend the neck in the opposite direction, i.e. straighten the neck. Further if after a period of time one end of the neck twists relative the other, one direction of the double arrow 93 in FIG. 14, upon tightening the appropriate one of the nuts, the channel is twisted in the opposite direction to straighten the neck. With this structure the neck is not subjected to direct compounding stresses of a rod being fastened to the extremities of the guitar neck. Further both bending and twisting forces or either one can be provided upon appropriately turning both or one of the nuts 89. Preferably the channel is made of aluminum.

With the skate and saddle assembly and the truss assembly properly adjusted, the guitar tuned and the handle assembly adjusted in the manner previously indicated, the counterbalance springs 26 retain the stop member in abutting relationship to the rear edge of the base plate 21*a*, even during the time the strings are being strummed. With the control arm 49 in about the position shown in FIG. 1, 2 and 6, upon depressing handle 49*b*, the handle assembly and shaft 24 are pivoted in the direction opposite arrow 28 which decreases the tension in the strings and thus lowers the pitch. In pivoting the handle assembly as indicated above, the pusher arm 37 pivots the stop member 25 in the same direction from its datum position of FIGS. 2 and 6 to increase the tension in the counterbalance springs 26. Upon releasing the depressing force on the control arm the counterbalance springs pivot the stop member in the direction of the arrow 28, the stop member in turn in abutting against the pusher arm pivots the handle assembly and shaft 24 in the same direction to return the shaft and stop member to their datum positions and increase the string tension.

To raise the pitch of the strings above that obtained with the shaft 24 in its datum position the control arm is manually pivoted in the direction of arrow 28 to pivot the shaft 24 in the same direction, it being noted there is a notch 96 beneath the mount 35 to open to slot 23 to permit the mount pivoting in the direction of arrow 28. However the stop member can not pivot in this direction due to it abutting against the rear edge of the base plate. Upon releasing the manual force on the control arm the tension in the Strings pivots the shaft 24 in the direction opposite arrow 28 to return the handle assembly and shaft to its datum position; the pusher arm 37 in abutting against the stop member limits the returning pivotal movement of the handle assembly and shaft 24 to the datum position. It is noted that due to the provision of grooves 30, 31, the pins can move a limited amount relative to the stop member. Further the base plate 21*a* and flange 21*b* cooperatively provide a notch 21*e* to permit the mount pivoting to pivot the shaft 24 as above described.

Referring to FIGS. 9–12, the second embodiment of the tremolo apparatus of this invention, generally designated 100, is secured to the body 101 of a stringed instrument such as a guitar by screws 102. The second embodiment includes a base having a base plate 104*a* and depending front and side flanges 104*d*, 104*b* and 104*c* that abut against the body to support the base plate spaced from the body. The rear end portions of the side flanges rotatably mount a transverse shaft 105 while a stop member 106 is mounted on shaft 105 for rotation relative thereto in a manner similar to the mounting of stop member 25 on shaft 24. The stop member 106 advantageously is of the same construction as that of stop member 25 other than it does not have a bar portion corresponding to portion 25*d*, but does have an arm 106*b* that in a dtum position extends forwardly of the rear edge 104*e* of the base plate, radially spaced from shaft 105 and extends transversely away from the adjacent end portion 106*c* that surrounds the shaft 105. Further the opposite end portion 106*a* that surrounds the shaft 105 has an ear abuttable against the bottom surface of the base plate to limit the rotation of the stop member to its datum position of FIG. 10. The ear has a cam surface abuttable against the top surface of the free terminal edge portion of the counterbalance leaf spring 107.

The end of the leaf spring opposite ear end portion 106*a* is mounted by a mounting member 108 which in turn is mounted by flange 104*c*. A pin 109 mounted by flange 104*c* abuts against the undersurface of the longitudinally intermediate portion of the leaf spring. A set screw 110 is threaded into the base plate for abutting against the top surface of the leaf spring longitudinally intermediate the mounting member 108 and pin 109 for adjusting the spring force exerted against the ear portion 106*a*. The leaf spring constantly resiliently urges the stop member to pivot in the direction of the arrow 112 to abut against the base plate.

The stop member 106 includes top grooves 30 and a rear groove 31 while string mounting pins 32 are mounted by the shaft 105 for mounting the one ends of the guitar strings (not shown). Further skate and saddle assemblies D are mounted on the base plate 104*a* even though not shown.

The handle assembly, generally designated 117, of the second embodiment includes members 41–45, 49, 50 and 52 that are the same as those of the first embodiment and are mounted on the handle assembly mount 118 in the same manner. However the mount 118 does not have a pusher arm joined thereto, but rather has a downwardly and forwardly opening notch 119 into which the arm portion 106*b* of the stop member extends. The mount is retained in a fixed angular position on and relative to the shaft by, for example, a set screw 120. The string tension maintains the shaft in such an angular position that mount 118 abuts against arm 106*b* to limit rotation of the arm 49, mount 118 and shaft 105 in the direction opposite arrow 112 to the datum position shown in the drawings when the guitar is not being played. Relative thereto the leaf spring has spring characteristics that the stop member is retained in abutting relationship to the base plate during normal playing of the guitar, provided the control arm is not depressed.

As the control arm 49 is manually depressed to rotate the shaft 105 in the direction opposite arrow 112, the stop member is rotated in the same direction by mount 118 acting against arm 106*b* whereby the cam surface of ear 106*a* moves the free terminal end portion of the leaf spring further away from the base plate and thus the spring force tending to rotate the stop member in the opposite direction increases. This rotation of shaft 105 in the direction opposite arrow 112 results in the pitch being lowered as described relative the first embodiment. Once the depressing force is released, the leaf spring returns the stop member to its datum position and therethrough the handle assembly to its datum position. It is noted that a recess 121 is provided by flange 104*b* and the base plate to permit mount 118 and arm 106*a* being pivoted in the direction opposite arrow 112.

When the control arm is raised the shaft 105 is rotated in the direction of arrow 112 to increase the tension in the strings and raise the pitch. However the stop member does not rotate in this direction as it abuts against the base plate. It is noted notch 119 is of a size and shape to permit this movement of the mount relative to arm 106*b*. Upon release of the raising force on the control arm the tension in the strings results in the shaft and handle assembly being returned to their datum positions.

With the second embodiment no opening such as 23, 27 has to be provided in the guitar body.

Figure 13:
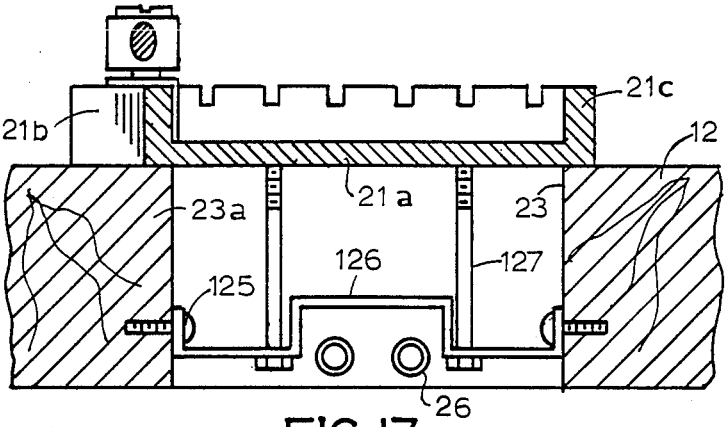
FIG. 13 is a fragmentary transverse cross sectional view generally taken along the line and in the direction of the arrows 13—13 of FIG. 17 of the third embodiment of the tremolo apparatus of this invention, the skate and addle assemblies and strings not being shown.
Figure 17:
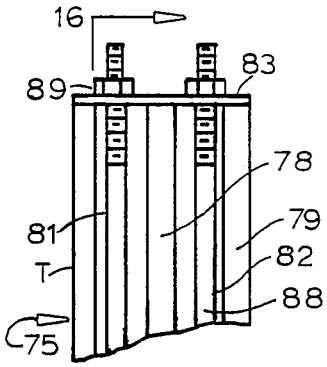
FIG. 17 is a fragmentary plan view of the third embodiment showing the location of the base relative to the slot through the guitar body.
Figure 17:
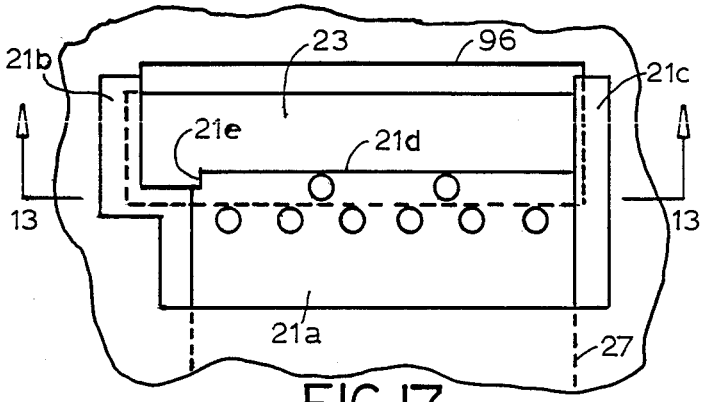

Referring to FIGS. 13 and 17, the third embodiment is the same as the first embodiment except that the base is not secured to the body by screws 22. Instead, screws 125 secure the opposite ends of the bracket 126 to the body wall portions that define opposite sides 23*a* of the slot 23. Bracket 126 is located a substantial distance below the top surface of the body. Screws or bolts 127 are extended through bracket 126 and threaded into the base plate 21*a* to firmly hold the base 21 in abutting relationship to the body 12. With reference thereto the base extends forwardly of slot 23 to have the forward end portion abut against the body, and rear portions of flanges 21*b*, 21*c* extend rearwardly of slot 23 and on opposite transverse sides of notch 96 to abut against the body.

With a guitar having a slot 23 in the body, by using the third embodiment the base may be secured to the body without having screws threaded into the top portion of the body, i.e., no screw holes open to the body top surface for mounting the base plate.

Figure 10:
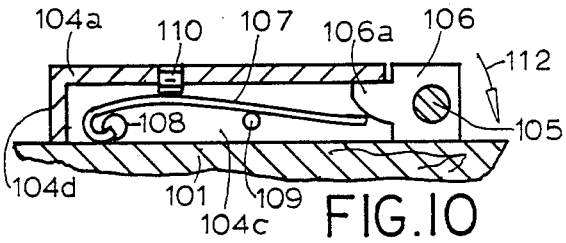
FIG. 10 is a fragmentary longitudinal cross sectional view generally taken along the line and in the direction of the arrows 10—10 of FIG. 9 to more clearly show the mounting of the counterbalance spring.
Figure 12:
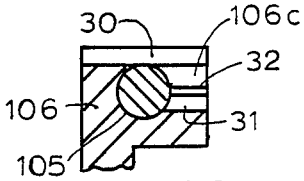
FIG. 12 is a transverse cross sectional view generally taken along the line and in the direction of the arrows 12—12 of FIG. 9.

If one does not find it objectionable to provide a top opening in the guitar body, the front flange 104*d* and the forward parts of flanges 104*b*, 104*c* can be eliminated, the base plate mounted in abutting relationship to the top surface of the body, an opening provided of a size for the leaf spring and stop member, the handle assembly mount and flange portions for mounting shaft 105 to operatively extend into, and members 108, 109 mounted by the body to extend into the opening in the same relationship to the base plate as shown in FIG. 10.

In place of springs 26, a torsion spring may be mounted on shaft 24 and have one end attached to stop member end portion 25 and the other end portion attached to flange 21*c* to perform the same function as springs 26. Similarly with reference to the second embodiment, in place of spring 107, a torsion spring may be mounted on shaft 105 and have one end attached to stop member end portion 106*a* and an opposite end portion attached to flange 104*c*.

With the tremolo apparatus of this invention the string mount can be pivoted in either direction from a datum position and the mount always returns to the same datum position upon the release of manual pressure to the handle regardless of loosening of one or more strings and of retuning of the guitar.

The handle assembly of the first embodiment may be modified by having the mount 35 extend a greater radial distance above the shaft with the bolt 43 threaded further into the mount and the upper part of the bolt extending into the mount being non-threaded, set screw 45 threaded into the mount to abut against said non-threaded upper part to prevent the bolt rotating, a flat washer optionally between the clamp block and mount in place of spring washer 44, and the spring washer between the head of bolt 43 and shoulder formed at the juncture of the upper and lower portions of bore 42. In such an event bolt 43 is not turned when the control arm 49 is pivoted in the direction of arrow 43 or the opposite direction but the amount of force required to pivot the control arm can be changed by loosening the set screw and varying the amount that the bolt is threaded into the mount as previously described.

Referring to FIGS. 18–21, the fourth embodiment of the tremolo apparatus of this invention, generally designated 140, includes a metal base W secured to the guitar body 145 by screws (not shown). The base includes a base plate 141 and a flange 142 that extends to a higher elevation than the base plate and is integrally joined to, or attached to, the rear end of the base plate. The flange has a transversely elongated opening 143 that extends vertically therethrough, the wall portions 142*a*, 142*b* of the flange defining the opposite ends of opening 143 having a transverse hole extending therethrough for pivotally mounting the shaft 144 of a string mount. Transversely elongated front and rear bar portions 142*e* and 142*d* of the flange in part define the opening 143 and have opposite ends integrally joined to the respective wall portion 142*a*, 142*b*. The top surfaces of the bar portions 142*d*, 142*e* may be at the same elevation as the top planar surface of the base plate, at about the same elevation as the transverse central axis of the shaft 144 and at a lower elevation than the top surface of the flange wall portions 142*a*, 142*b*.

The string mount also includes a string mount annular portion 146*a* which may be press fitted on the shaft to rotate therewith, or is rotatably mounted on the shaft, end string spacer plates 146*f*, 146*e* and string spacer plates 146*c* that are mounted on, or integrally joined to the annular portion in transverse spaced relationship and extend thereabove to provide a groove 146*d* for each instrument string 150. The rear end of each string has an enlarged rear end bead 150*a* of a diameter greater than the transverse dimension of a groove 146*d* and is lodged in the rear nip formed where the annular member and adjacent spacer plates abut or are joined to mount the rear end of the strings as long as the strings are in tension. It is to be understood that in place of a plurality of spacer plates 146*c*, 146*e*, 146*f*, there may be provided a single plate having a groove for each string that extends across the top of the plate and downwardly through the top and rear parts of the plate. Alternately in place of the spacer plates and the annular member the strings may be mounted by a stop member 106 (other than for portions 106*b*, 106*a*) and pins 32 such as described with reference to the second embodiment. As thus modified the stop member 106 would no longer function as a stop member.

There is provided a handle assembly that includes a mount 148 fixedly secured or integrally joined to one transverse end of the annular member 146*a*, and extends transversely outwardly of member 146*a* to have a cut out transversely outwardly of the annular member that is defined in part by an arcuately curved wall 148*a* that extends through an arc of, for example, about 90° and a radius of curvature slightly larger than the outer radius of the annular member. The cut out as viewed in the FIG. 19 datum position of the handle mount is also in part defined by a wall 148*b* that from its juncture with wall 148*a* extends upwardly and forwardly to intersect a horizontally forwardly extending wall 148*c*. In the datum position wall 148*c* is at a substantially higher elevation than the top surface of bar portion 142*e* and extends transversely across the mount to in part permit the mount being pivoted in a direction opposite arrow 153 as described herein.

The handle assembly also includes a handle 149 that is somewhat L-shaped and has its short leg pivotally mounted in an aperture in mount 148 to be releasably retained in a given pivoted position by a set screw (not shown). If the annular member is fixed to the shaft the mount may be modified to be keyed to the shaft and would be keyed to the shaft if a modified stop member 106 as described above were used.

A stop member 152 is in part located in the handle mount cut out and has an annular portion pivotally mounted on the shaft 144 and, as viewed in FIG. 19, has an ear with wall portions complimentary to walls 148*b*, 148*c* and a front end portion to extend into abutting relationship to the bottom surface of the overhanging flange part 142*c* of the flange for limiting the rotation of the stop member in the direction of arrow 153 about the shaft central axis. A coiled torsion spring 154 has one end mounted by the stop member and an opposite end by a worm gear 155 that in turn is mounted on the shaft for rotation relative to the shaft. A worm screw 156 is mounted by the base whereby rotating the screw in one direction, the spring force in the spring is increased and in the opposite direction, the spring force is decreased. That is, the worm screw is in part mounted by flange part 142*c* and a tab part 142*m* of flange wall portion 142*b* with the tab part vertically spaced from flange part 142*c*. The flange and tab parts may be provided by an appropriately shaped cut out 142*n* that opens to opening 143 and provides parts 142*c*, 142*m* and permits movement of the stop member 152 and the hand mount 148 as described herein.

Until the handle is manually pivoted in the direction of, or opposite the direction of, arrow 153, worm assembly and the coil spring act to retain the stop member in abutting relationship to flange part 142*c*; and if no manual pressure is applied to the handle, through the handle mount wall 148*c* abutting against the stop member, limits the movement of the handle mount in the direction opposite arrow 153 to the position shown in FIG. 19. That is, when no manual pressure is applied to depress or move the handle upwardly, the tension in the coil spring is sufficiently great to offset the tension in the strings acting to urge the string mount and thereby the handle to rotate in a direction opposite of arrow 153 from the datum position of FIG. 19. However when the handle is depressed the tension in the strings decreases and the handle mount is pivoted in the direction opposite arrow 153, and when the handle is moved upwardly to pivot the handle mount in the direction of arrow 153 from the datum position of FIG. 19, the string tension increases and the stop member remains in its datum position.

In place of using shaft 144 and annular member 146*a*, member 146*a* may be a solid cylindrical rod having a metal pin extended into the right hand end of the rod and pivotally mounted by wall portion 142*a* and a second metal pin (not shown) extended into a hole in the other end of the rod (not shown) and pivotally mounted by the wall portion 142*b*. In such a modification the rod would be fixed to the pins, the worm gear and stop member pivotally mounted on the second pin and the handle mount fixed to the adjacent end portion of the rod to extend transversely away therefrom to provide the cut out into which the stop member 152 would extend.

The base plate 141 has a longitudinally elongated, dovetailed groove 159 for each string that is substantially longitudinally aligned with the respective string mount groove 146*d*, and opens upwardly through the top planar surface of the base plate. For each groove 159 there is provided a metal saddle and skate assembly K that includes a skate 160, a slide block 161 and a screw 162. The skate 160 has a rectangular recess 164 extending transversely thereacross that opens downwardly through the block bottom planar surface. The slide block includes a top portion 161*a* that extends up into the recess and is of a vertical dimension significantly less than the corresponding dimension of the recess. The slide block also has a lower tenon portion 161*b* with transversely opposite sides that converge upwardly at angles complimentary to those of the side surfaces of the grooves, and an intermediate portion that integrally joins the tenon portion to the top portion. The intermediate portion is of a vertical dimension that permits the tenon portion being moved upwardly to a clamp position so that the upwardly converging surfaces of the tenon are in substantially flat abutting relationship with the groove side surfaces. The portion 161*a* and recess 164 are of relative sizes to permit movement of the skate and slide block relative to each other and the base plate as described herein.

The screw 162 is extended through a transversely elongated slot 165 in skate 160 and threaded into the slide block to move the slide block upwardly in the recess 164 until the tenon side surfaces clampingly abut against the base plate groove side surfaces. When it is desired to adjust the longitudinal position of a skate the respective screw 162 is unthreaded sufficiently to permit moving the skate and then tightened to hold the skate in the desired adjusted position. When the screws are threaded to the slide blocks' clamp positions, the heads of the screws retain the skates 160 with their planar surfaces abutting against the flat top surfaces of the base plate top surfaces of the base plate on either transverse side of the respective groove. Due to the provision of the transversely elongated slots 165, the positions of the skates may be adjustably transversely positioned when the screws 162 are loosened. Each saddle assembly 167 is of the same construction as a saddle assembly 62 and is threaded into the respective skate 160. A set screw (not shown) is provided to be threaded into the respective skate and abut against the saddle assembly threaded portion to firmly hold the saddle assembly in its vertically adjusted position and prevent it moving relative to the skate during the time the instrument is being played in order to provide solid structure for transmitting sound vibrations from the saddle assembly rollers to the guitar body. That is, the only part of the saddle and skate assemblies K that can move relative to the body during playing is the roller. The transverse adjustment feature of the assemblies permit the grooves of the saddle rollers being more precisely aligned with the extension of the strings from the guitar head to the string mount.

By providing the worm adjustment feature, the force required to be exerted on the handle to pivot the string mount member in the direction opposite arrow from its datum position can be selectively adjustably varied; or if the string tension changes over time, adjusted to compensate for the change in string tension in so far as the force required to pivot the handle is concerned.

What is claimed is:

1. Tremolo apparatus for a stringed instrument having a head, a body, a neck connecting the head to the body and strings having one ends connected to the head and opposite ends, comprising a base, means for securing the base to the body, a string mount pivotally mounted on the base for having the strings' opposite ends mounted thereby, a handle assembly mounted on the string mount for pivoting the string mount in a first direction for increasing the tension in the strings and a second direction for decreasing the tension in the strings, stop means mounted on the string mount for pivotal movement between a datum position abutting against one of the body and the base for limiting pivotal movement of the handle assembly in the second direction to a datum position when no manual pressure is applied to the handle assembly, permitting the handle assembly being manually pivotally moved in the first direction from its datum position, and being pivotally moved to a position out of abutting engagement with the one of the body and base when the handle assembly is manually pivotally moved in the second direction, and spring means acting against the stop means for constantly resiliently urging the stop means to pivot to its datum position.

2. The apparatus of claim 1 further characterized in that the base includes a base plate portion having a top planar surface and that there is provided a skate and saddle assembly for each string, each assembly including a skate having a planar bottom surface in flat abutting relationship with the plate planar surface portion, means for securing the skate to the base in various selected adjusted fixed positions and a saddle abuttable against a string and mounted by the skate to extend various selected adjusted distances from the plate portion, each saddle including a roller for having a string movably extended thereover, and means for mounting the roller for rotation about an axis parallel to the plate portion top surface and retaining the roller at various adjusted spaced relationships from the plate portion top surface.

3. The apparatus of claim 1 further characterized in that the spring means includes a coil spring having a first end attached to the stop means and a second end, and adjustment means at least in part mounted by the base and having the spring second end connected thereto for selectively varying the effective spring force of the spring and thereby the force required to pivot the stop means from its datum position.

4. The apparatus of claim 1 further characterized in that the string mount has a pivot axis and that the handle assembly includes a manually operated control arm, and means for mounting the control arm on the string mount for pivotal movement relative to the string mount about a pivot axis that is perpendicular to a plane that in turn is parallel to the string mount pivot axis and selectively adjustably varying the force required to pivot the arm relative to the shaft.

5. The apparatus of claim 4 further characterized in that the last mentioned means includes a handle assembly mount keyed to the string mount, a clamp block, means for attaching the clamp block to the handle assembly mount for pivotal movement relative to the string mount about said pivot axis that is perpendicular to a plane that is parallel to the string mount axis and pivotally moving the handle assembly mount about the string mount axis when a manual depressing or raising force is applied to the control arm, and means mounted by the clamp block for retaining the control arm in various selected adjusted angular positions relative to the clamp block.

6. A stringed instrument such as a guitar having a head, a body, a longitudinally elongated neck connecting the head to the body, plurality of strings having one ends connected to the head and opposite ends, means for connecting the strings' opposite ends to the body, said neck having a longitudinally elongated groove, and channel means for counterbalancing twisting and bending of the neck, said channel means including a longitudinally elongated channel mounted in the neck groove, said channel having first and second end walls, and longitudinal first, second and third legs extending between and joined to the end walls and a web joined to the legs and end walls to define first and second longitudinally elongated grooves that open outwardly away from the web, and first and second rod means mounted in the first and second grooves respectively and acting against the end walls for selectively bending and twisting the channel to through the channel act against the neck to straighten the neck.

7. The apparatus of claim 6 further characterized in that there is provided a fretboard on the neck in overlaying relationship to the channel and groove, that the legs have free terminal longitudinal edges opposite the web from the fretboard, and that the rod means are located more closely adjacent the web than said leg terminal edges.

8. The apparatus of claim 7 further characterized in that the first and third legs have remote side surfaces that diverge in a direction from the free terminal edges toward the web and that the grooves diverge from one another in a direction from the free terminal edges toward the web.

9. The apparatus of claim 6 further characterized in that the means for connecting the strings to the body comprises a tremolo assembly that includes a base, means for securing the base to the body, a transverse string mount mounted by the base for pivotal movement about a transverse pivot axis and mounting the opposite ends of the strings for movement therewith, a stop member mounted on the string mount for pivotal movement in a first direction to a datum limit position abutting against the base and in an opposite angular second direction, spring means acting between the stop member and one of the base and body for resiliently retaining the stop member in its datum position, a manually operated handle assembly keyed to the string mount for pivoting the string mount in the selected one of said directions, resiliently retained in abutting relationship to the stop member through the string tension acting through the string mount urging the string mount to pivot in the second direction when no manual pressure is applied thereto, and to pivot the string mount and stop member in the second direction when manually depressed.

10. The apparatus of claim 9 further characterized in that the handle assembly includes a handle assembly mount keyed to the string mount, an elongated control arm, and adjustable means for mounting the control arm for pivotal movement on the handle assembly mount, retaining the control arm in selected adjusted positions to vary the effective length thereof and retaining the control arm in selected adjusted angular relationships to the handle assembly mount.

11. The apparatus of claim 9 further characterized in that it includes a skate and saddle assembly for each string mounted on the base between the neck and the string mount, each skate and saddle assembly including a skate having a bottom planar surface retained in flat abutting relationship to the base, a grooved roller between the respective string and the base and in rotating abutting relationship to the string, and means mounted by the base for mounting the roller for rotation about a transverse axis and selectively adjustably varying the spacing of the roller from the base.

12. A stringed instrument such as a guitar or the like having a head, a body, a neck connecting the head to the body, a plurality of longitudinally elongated strings having one ends connected to the head and opposite ends, and a tremolo assembly for connecting the opposite ends of the strings to the body, said assembly including a base, means for attaching the base to the body, a transverse string mount mounted by the base for pivotal movement about a transverse axis and mounting the opposite ends of the strings for movement therewith, a stop member mounted by the string mount for pivotal movement about said axis in a first angular direction to a datum limit position abutting against one of the base and body and in an opposite angular second direction, spring means acting between the stop member and one of the base and the body for resiliently retaining the stop member in its datum position, a handle assembly keyed to the string mount for pivoting the string mount in the selected one of said directions, resiliently retained in abutting relationship to the stop member through the string tension acting through the string mount urging the string mount to pivot in the second direction when no manual pressure is applied thereto, and to pivot the string mount and stop member in the second direcaway from the datum position when manually depressed.

13. The apparatus of claim 12 further characterized in that the body has a top surface and wall portions defining a slot extending therethrough and opening through the top surface to at least in part open to the base, and that the means for attaching the base to the body includes a bracket located within said slot, means for fastening the bracket to said wall portions, and means extending within the slot and between the bracket and base for retaining the base in abutting relationship to said top surface.

14. The apparatus of claim 12 further characterized in that the body has a slot extending beneath the base and opening to the base, that the stop member includes an upper portion rotatably mounted by the string mount and a lower portion dependingly joined to the upper portion to extend within the slot, the spring means extending within the slot and being connected between the lower portion and the body, and that the handle assembly includes a control arm, means for mounting and keying the control arm to the string mount and a pusher arm joined to the last mentioned means that is resiliently retained in abutting relationship with the lower portion through the string tension acting through the string mount and said last mentioned means when no manual pressure is applied to the control arm and that is moved angularly away from the lower portion when the control arm is angularly moved in said first direction.

15. The apparatus of claim 12 further characterized in that the base includes a base plate and flanges dependingly joined thereto for supporting the base plate in spaced relationship to the body and that the spring means includes a spring having a first end mounted by one of the flanges and an opposite end portion acting against the stop member.

16. Tremolo apparatus for a stringed instrument having a head, a body, a neck connecting the head to the body and strings having one ends connected to the head and opposite ends, comprising a base, means for securing the base to the body, a string mount pivotally mounted by the base for having the strings' opposite ends mounted thereby, a handle assembly mounted by the string mount for pivoting the string mount in a first direction for increasing the tension in the strings and a second direction for decreasing the tension in the strings, stop means mounted by the string mount for pivotal movement between a datum position abutting against one of the body and the base for limiting pivotal movement of the handle assembly in the second direction to a datum position when no manual pressure is applied to the handle assembly, permitting the handle assembly being manually pivotally moved in the first direction from its datum position, and being pivotally moved in the second direction when the handle assembly is manually pivotally moved in the second direction, and spring means acting against the stop means for constantly resiliently urging the stop means to pivot to its datum position, the string mount including a transverse shaft rotatably mounted by the base, and the stop means including a first portion rotatably mounted by the shaft, a second portion joined to the first portion for abutting against the handle assembly to rotate the handle assembly in the first direction after the handle assembly has been manually rotated in the second direction from the datum position and the manual pressure is released.

17. The apparatus of claim 16 further characterized in that the spring means includes a spring having one end connected to the second portion and that the handle assembly includes a pusher arm abuttable against the second portion for pivoting the handle assembly in the first direction when the stop means pivots in the first direction.

18. The apparatus of claim 16 further characterized in that the base includes a base plate having a bottom rear surface portion, that the stop means includes a third portion joined to the second portion to rotate therewith and that the spring means includes a leaf spring mounted by the base for acting against the third portion for constantly resiliently urging the third portion to rotate in the first direction, one of the stop means portions being abuttable against the plate rear surface portion for limiting pivotal movement of the stop means in the first direction.

19. The apparatus of claim 18 further characterized in that the base has depending flanges for supporting the base plate in spaced relationship to the body.

20. Tremolo apparatus for a stringed instrument having a head, a body, a neck connecting the head to the body and strings having one ends connected to the head and opposite ends, comprising a base that includes a base plate portion having a top planar surface, means for securing the base to the body, a string mount pivotally mounted on the base for having the string opposite ends mounted thereby, a handle assembly mounted on the string mount for pivoting the string mount in a first direction for increasing the tension in the strings and a second direction for decreasing the tension in the strings, stop means mounted on the string mount for pivotal movement between a datum position abutting against one of the body and the base for limiting pivotal movement of the handle assembly in the second direction to a datum position when no manual pressure is applied to the handle assembly, permitting the handle assembly being manually pivotally moved in the first direction from its datum position, and being pivotally moved in the second direction when the handle assembly is manually pivotally moved in the second direction, the stop means having a top groove for each string to extend through and a rear groove opening to the string mount and the top groove, the string mount including a transverse shaft rotatably extended through the stop means and rotatably mounted by the base and a pin for each string mounted by the shaft to rotate therewith and extend in the last mentioned groove for being rotatable relative to the stop means, spring means acting against the stop means for constantly resiliently urging the stop means to pivot to its datum position, and a skate and saddle assembly for each string located forwardly of the stop means, each assembly including a skate having a planar bottom surface in flat abutting relationship with the plate planar surface portion, means for securing the skate to the base in a fixed position and a saddle abuttable against a string and mounted by the skate to extend various selected adjusted distances from the plate portion.

21. Tremolo apparatus for a stringed instrument having a head, a body, a neck connecting the head to the body and strings having one ends connected to the head and opposite ends, comprising a base, means for securing the base to the body, a transverse shaft mounted on the base and having a central transverse axis, a string, mount member mounted on the shaft for having the strings' opposite ends mounted thereby, at least one of the string mount member and shaft being mounted for pivotal movement about said axis, a handle assembly mounted on the string mount member for pivoting the string mount member in one direction for decreasing tension in the strings, stop means mounted on the string mount member for pivotal movement between a datum position abutting against one of the body and the base for limiting pivotal movement of at least one of the string mount member and the handle assembly in said one direction to a datum position when no manual pressure is applied to the handle assembly and permitting the handle assembly and string mount member being pivoted in said one direction from the datum position when the handle assembly is manually pivoted in said one direction, torsion spring means provided on the shaft and acting against the stop means for constantly resiliently urging the stop means to its datum position and adjustment means mounted by the base and having the spring means connected thereto for selectively varying the effective spring force in the spring means that urges the stop means to its datum position.

22. A stringed instrument such as a guitar or the like having a head, a body, a neck connecting the head to the body, a plurality of strings having one ends connecting to the head and opposite ends, and an assembly for connecting the opposite ends of the strings to the body, said assembly including a base having a generally planar flat surface portion, means for attaching the base to the body and retaining the base in abutting relationship to the body, a string mounted by the base for mounting the opposite ends of the strings, and a skate and saddle assembly for each string mounted on the base between the neck and string mount, each skate and saddle assembly including a skate having a bottom planar surface portion, means in engagement with the base and the skate for retaining the skate with the skate planar surface portion in flat abutting relationship to the base flat surface portion in various selected adjusted positions relative to the base and the string mount, even while the instrument is being played, a roller between the respective string and the base and in abutting relationship to the string, and means mounted on the skate for movement therewith for mounting the roller for rotation about an axis perpendicular to the direction of extension of the string thereover and retaining the roller in various selected vertically adjusted, vertically fixed positions relative to the skate and the base, even while the instrument is being played, to insure good transmission of vibrations from the saddle to the skate and therethrough to the base.

23. The apparatus of claim 22 further characterized in that said assembly comprises a tremolo assembly, that the base has wall portions defining a longitudinally elongated groove for each skate and saddle assembly that opens upwardly through the base planar surface, that each skate has a downwardly opening recess, that the means for retaining the skate in an adjusted position includes a slide block having an upper portion extending into the skate recess and a tenon portion mounted in the respective groove for longitudinal movement and limited vertical movement in the groove between a position clampingly engaging the wall portion to retain the skate in an adjusted position and a release to permit longitudinally adjusting the position of the skate, and means acting against the skate and tenon portion for selectively moving the tenon portion between its positions.

24. The apparatus of claim 22 further characterized in that the means in engagement with the base and skate comprises means mounting the skate for limited transverse and longitudinal adjustable movement relative to the base and retaining the skate in the adjusted position relative to the base.

25. The apparatus of claim 22 further characterized in that the means for mounting the roller comprises a saddle for mounting the roller for rotation, said saddle being mounted by the skate for vertical adjustment and means mounted by the skate to retain the saddle in selected vertically adjusted, fixed positions relative to the skate, even when the instrument is being played.

26. A stringed instrument such as a guitar or the like having a head, a body, a neck connecting the head to the body, a plurality of strings having one ends connected to the head and opposite ends, and a tremolo assembly for connecting the opposite ends of the strings to the body, said tremolo assembly including a base having a generally planar flat surface portion, means for attaching the body and retaining the base in abutting relationship to the body, a string mount mounted by the base for mounting the opposite ends of the strings, and a skate and saddle assembly for each string mounted on the base between the neck and the string mount, each skate and saddle assembly including a skate having a bottom planar surface portion, means in engagement with the base and the skate for retaining the skate with the skate planar surface portion in flat abutting relationship to the base flat surface portion in various selected adjusted positions relative to the base and the string mount, even while the instrument is being played, a roller between the respective string and the base and in abutting relationship to the string, and means mounted on the skate for movement therewith for mounting the roller for rotation about an axis perpendicular to the direction of extension of the string thereover and retaining the roller in various selected vertically adjusted positions relative to the skate and base to insure good transmission of vibrations from the saddle to the skate and therethrough to the base while the instrument is being played, the base having a wall portion defining a longitudinally elongated groove for each skate and saddle assembly that opens upwardly through the base planar surface, each skate having a downwardly opening recess, the means for retaining the skate in an adjusted position including a slide block having an upper portion extending into the skate recess and a tenon portion mounted in the respective groove for longitudinal movement and limited vertical movement in the groove between a position clampingly engaging the wall portion to retain the skate in an adjusted position and a release position to permit longitudinally adjusting the position of the skate, and means acting against the skate and tenon portion for selectively moving the tenon portion between its position and the skate recess extending transversely and having a transversely elongated slot through which the means acting against the skate extends to permit transverse adjustment of the skate relative to the groove when the tenon portion is in its release position.

* * * * *